US011538615B2

(12) United States Patent
Serizawa

(10) Patent No.: US 11,538,615 B2
(45) Date of Patent: Dec. 27, 2022

(54) REACTOR AND METHOD OF MANUFACTURING THE SAME

(71) Applicant: TOYOTA JIDOSHA KABUSHIKI KAISHA, Toyota (JP)

(72) Inventor: Kazumi Serizawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 596 days.

(21) Appl. No.: 16/568,334

(22) Filed: Sep. 12, 2019

(65) Prior Publication Data

US 2020/0098502 A1 Mar. 26, 2020

(30) Foreign Application Priority Data

Sep. 25, 2018 (JP) ..... JP2018-179391
Feb. 4, 2019 (JP) ..... JP2019-018163

(51) Int. Cl.

| | |
|---|---|
| ***H01F 27/08*** | (2006.01) |
| ***H01F 27/02*** | (2006.01) |
| ***H01F 27/26*** | (2006.01) |
| ***H01F 27/28*** | (2006.01) |
| ***H01F 27/30*** | (2006.01) |
| ***H01F 27/32*** | (2006.01) |
| ***H01F 37/00*** | (2006.01) |
| ***H01F 41/02*** | (2006.01) |

(52) U.S. Cl.

CPC ..... *H01F 27/08* (2013.01); *H01F 27/022* (2013.01); *H01F 27/263* (2013.01); *H01F 27/2823* (2013.01); *H01F 27/306* (2013.01); *H01F 27/327* (2013.01); *H01F 37/00* (2013.01); *H01F 41/02* (2013.01)

(58) Field of Classification Search

CPC ..... H01F 27/08; H01F 27/022; H01F 27/263; H01F 27/2823; H01F 27/306; H01F 27/327; H01F 37/00; H01F 41/02; H01F 27/22; H01F 27/323; H01F 41/04; H01F 41/122; H01F 27/2847; H01F 27/324; H01F 41/00; H01F 41/125

See application file for complete search history.

(56) References Cited

FOREIGN PATENT DOCUMENTS

| | | | | |
|---|---|---|---|---|
| JP | 2016-092313 A | 5/2016 | | |
| WO | WO-2014072815 A1 * | 5/2014 | ..... | H01F 27/022 |
| WO | WO-2014096953 A1 * | 6/2014 | ..... | H01F 27/022 |

* cited by examiner

*Primary Examiner* — Tuyen T Nguyen
(74) *Attorney, Agent, or Firm* — Oliff PLC

(57) ABSTRACT

A reactor includes a coil including a wire that is covered with an insulating film and is wound, the coil including a first lateral surface and a second lateral surface different from the first lateral surface; a cooler that faces the first lateral surface; and an insulating heat radiation layer that is sandwiched between the first lateral surface and the cooler. In the first lateral surface, the wire is not covered with the insulating film. In the second lateral surface, the wire is covered with the insulating film. A degree of flatness of the first lateral surface is lower than a degree of flatness of the second lateral surface.

4 Claims, 8 Drawing Sheets

REACTOR AND METHOD OF MANUFACTURING THE SAME

INCORPORATION BY REFERENCE

The disclosure of Japanese Patent Application No. 2019-018163 filed on Feb. 4, 2019 including the specification, drawings and abstract is incorporated herein by reference in its entirety.

BACKGROUND

1. Technical Field

The disclosure relates to a reactor and a method of manufacturing the reactor. In particular, the disclosure relates to a reactor having a cooler that is opposed to a flat lateral surface of a coil across an insulating heat radiation layer, and a method of manufacturing the reactor.

2. Description of Related Art

There is known a reactor having a cooler that is opposed to one lateral surface of a coil, which has been wound into the shape of a prism, across an insulating heat radiation layer (e.g., Japanese Patent Application Publication No. 2016-92313 (JP 2016-92313 A)). The insulating heat radiation layer is adopted to provide assistance in transmitting heat from the coil to the cooler. Each of portions of a wire constituting the coil is covered with an insulating film so as not to short-circuit to the portions of the wire that are adjacent to the portion of the wire in a pitch direction. The insulating film lowers the efficiency of heat transmission from the coil to the insulating heat radiation layer. In the reactor of Japanese Patent Application Publication No. 2016-92313 (JP 2016-92313 A), the insulating film has been removed from that one of lateral surfaces of the coil which is opposed to the insulating heat radiation layer. The insulating heat radiation layer provides assistance in transmitting heat from the coil (the portions of the wire) to the cooler, and insulates the exposed portions of the wire of the coil from the cooler. Incidentally, in the present specification, each surface of the coil that is parallel to an axis thereof will be referred to as "the lateral surface of the coil".

SUMMARY

When the insulating heat radiation layer becomes thin, the distance between the coil and the cooler becomes short, so that the efficiency of heat transmission becomes high. However, when the degree of flatness of each of the lateral surfaces of the coil is high (when each of the lateral surfaces of the coil is coarse), the distances between various spots of the lateral surface and the cooler vary. That is, the distance between the winding located closest to the cooler and the winding located furthest from the cooler becomes long. When the distance between the winding located closest to the cooler and the winding located furthest from the cooler becomes long, the thickness of the insulating heat radiation layer needs to be increased. The thermal resistance of the insulating heat radiation layer increases as the thickness thereof increases. Therefore, the efficiency of heat transmission falls at the spots where the insulating heat radiation layer is thick. Furthermore, when the thickness of the insulating heat radiation layer increases, a fissure becomes likely to be created in the insulating heat radiation layer. When gaps (air bubbles) are produced due to the fissure, a fall in the efficiency of heat transmission is caused. On the other hand, each of the lateral surfaces of the coil is formed of an aggregate of the portions of the wire that are aligned in an axial direction of the coil. When the positions of the portions of the wire in a radial direction of the coil deviate, the degree of flatness becomes relatively high. In the reactor of Japanese Patent Application Publication No. 2016-92313 (JP 2016-92313 A), the degree of flatness of the lateral surface of the coil that is opposed to the cooler is not taken into account, and there is room for improvement.

Incidentally, the degree of flatness may be evaluated as, for example, a maximum inclination-type degree of flatness. The maximum inclination-type degree of flatness is represented by a distance between two parallel ideal planes when a plane to be measured is sandwiched between the ideal planes. It should be noted herein that each of "the ideal planes" means a perfect plane with no undulations as expressed by a mathematical equation about planes. The similarity of the plane to be measured to the ideal plane increases as the degree of flatness decreases. Besides, in the disclosure, the degree of flatness is evaluated while ignoring the roundness of transverse sections of the portions of the wire.

When an attempt is made to lower the degrees of flatness of all the lateral surfaces of the coil that is formed of the wire, the entire coil is restrained, and a stress is applied to various spots of the coil. The stress emerges in the form of springback, and the alignment of the portions of the wire on each of the lateral surfaces of the coil is disturbed. Thus, in the reactor according to the disclosure, a stress is restrained from being produced, by allowing the degree of flatness to be high on the lateral surfaces of the coil that are not opposed to the cooler, and the low degree of flatness is maintained on the lateral surface of the coil that is opposed to the cooler.

A reactor according to a first aspect of the disclosure includes a coil including a wire that is covered with an insulating film and is wound, a cooler, and an insulating heat radiation layer. The coil includes a first lateral surface and a second lateral surface different from the first lateral surface. The cooler faces the first lateral surface. The insulating heat radiation layer is sandwiched between the first lateral surface and the cooler. In the first lateral surface, the wire is not covered with the insulating film. In the second lateral surface, the wire is covered with the insulating film. A degree of flatness of the first lateral surface is lower than a degree of flatness of the second lateral surface.

The second lateral surface may be a curved surface that extends from one edge of the first lateral surface to the other edge thereof, or may include a plurality of flat lateral surfaces. In the latter case, the coil has a polygonal prism shape.

In the reactor according to the first aspect of the disclosure, the lowered degree of flatness of the first lateral surface that is opposed to the cooler can be maintained by allowing the degree of flatness of the second lateral surface different from the first lateral surface that is opposed to the cooler to be high. By lowering the degree of flatness of the first lateral surface that is opposed to the cooler, the variation in the thickness of the insulating heat radiation layer decreases. As a result, heat is uniformly transmitted from various spots of the first lateral surface to the cooler, and the efficiency of heat transmission from the coil to the cooler is enhanced. Besides, since the variation in the first lateral surface of the coil has decreased, the insulating heat radiation layer can be reduced in thickness. Since the insulating heat radiation layer has been reduced in thickness, the creation of a fissure is suppressed, and the efficiency of heat transmission is restrained from falling due to the creation of a fissure. Incidentally, surfaces of the portions of the wire from which the insulating film has been removed may be referred to hereinafter as "exposed surfaces".

The coil may include the wire that is a rectangular wire wound in an edgewise manner. In an outer region of a sectional shape of the coil obtained by cutting a region of the coil which is in contact with the insulating heat radiation layer, a gap may be provided between portions of the wire that are adjacent to each other. Gaps are ensured among the exposed surfaces of the portions of the wire that are aligned in a pitch direction. Conductors are exposed on the exposed surfaces. Therefore, when the exposed surfaces that are adjacent to each other are close to each other, short-circuiting may be caused. Since the gaps are ensured among the exposed surfaces that are aligned in the pitch direction, the exposed surfaces that are adjacent to each other in the pitch direction can be prevented from short-circuiting to each other.

In a region of the coil which is in contact with the insulating heat radiation layer, a thickness of the wire in an inner portion of the coil may be larger than a thickness of the wire in an outer portion of the coil. Thus, a gap is ensured between the exposed surfaces that are adjacent to each other, and the exposed surfaces can be prevented from short-circuiting to each other. Besides, a thickness of the wire at a corner portion of the coil that is adjacent to the first lateral surface may be larger on an inner peripheral side of the coil than on an outer peripheral side of the coil as viewed in an axial direction of the coil. Thus, a gap is ensured between the exposed surfaces that are adjacent to each other, and the exposed surfaces can be prevented from short-circuiting to each other.

Besides, in the reactor according to the foregoing aspect, in a region of the wire that is in contact with the insulating heat radiation layer, a space between portions of the wire that are adjacent to each other in a pitch direction may be filled with an insulating material. When conductive dust or the like is stuck near the exposed surfaces of the portions of the wire, the exposed surfaces that are adjacent to each other in the pitch direction may short-circuit to each other. By filling the space between the portions of the wire that are adjacent to each other with the insulating material, conductive dust can be prevented from being stuck therein.

In the reactor according to the foregoing aspect, a surface of the cooler which is in contact with the insulating heat radiation layer may be conductive, and the insulating heat radiation layer may include a ceramic board. Alternatively, the insulating heat radiation layer may include silicon and a ceramic board. When there are small air bubbles (micro-voids) between the portions of the wire that are adjacent to each other or in the insulating heat radiation layer, corona discharge may occur between the portions of the wire and the cooler. Corona discharge causes carbonization of resin and the insulating film, and may lead to the short-circuiting of the exposed surfaces that are adjacent to each other in the pitch direction. Since the insulating heat radiation layer includes the ceramic board, the occurrence of corona discharge can be prevented. Besides, some ceramic materials exhibit high thermal conductivity. By adopting such a ceramic board, an effect of enhancing the efficiency of heat transmission from the coil to the cooler is obtained.

In the reactor according to the foregoing aspect, a slit may be provided in a surface of a portion of the wire, the surface of the portion of the wire being not covered with the insulating film. When a current flows through the coil, the coil generates heat. When the coil generates heat, the wire expands. When the wire expands, the exposed surfaces that are adjacent to each other in the pitch direction approach each other, and may short-circuit to each other. By providing the portions of the wire with the slits respectively, the expansion of the portions of the wire can be absorbed, and the occurrence of short-circuiting can be prevented.

A second aspect of the disclosure relates to a method of manufacturing the above-mentioned reactor. The method includes winding the wire, from which the insulating film has not been removed, to form the coil having the first lateral surface, and removing the insulating film by polishing the first lateral surface such that the degree of flatness of the first lateral surface becomes lower than the degree of flatness of the second lateral surface. By polishing the first lateral surface of the coil after winding the wire, the degree of flatness can be made low while removing the insulating film.

Before removing the insulating film by polishing the first lateral surface, a space between portions of the wire that are adjacent to each other in a pitch direction may be filled with an insulating material. By filling the gap between the portions of the wire that are adjacent to each other with resin, polishing waste can be prevented from being stuck between the portions of the wire.

BRIEF DESCRIPTION OF THE DRAWINGS

Features, advantages, and technical and industrial significance of an exemplary embodiment of the disclosure will be described below with reference to the accompanying drawings, in which like numerals denote like elements, and wherein.

DETAILED DESCRIPTION OF EMBODIMENT

Figure 1:
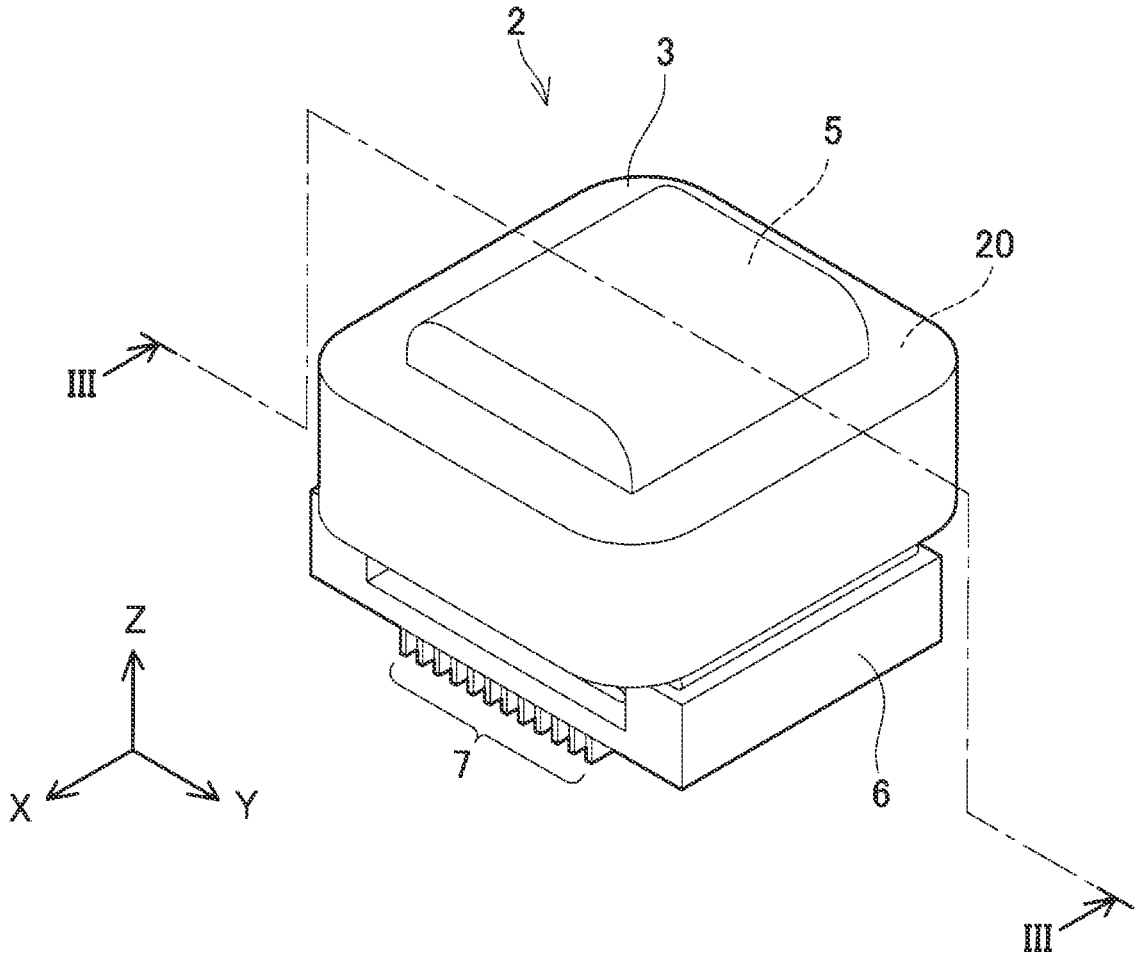
FIG. 1 is a perspective view of a reactor according to the embodiment.
Figure 2:
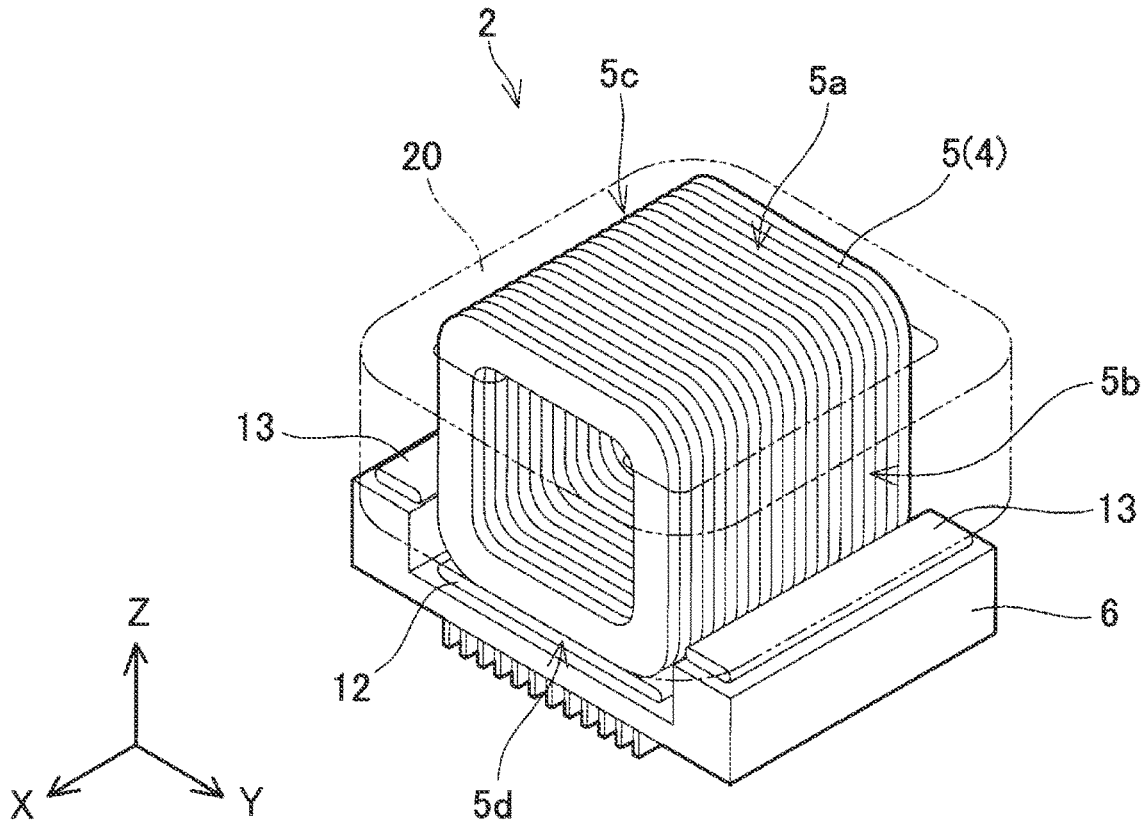
FIG. 2 is a perspective view of the reactor according to the embodiment (with no core and no resin cover)
Figure 3:
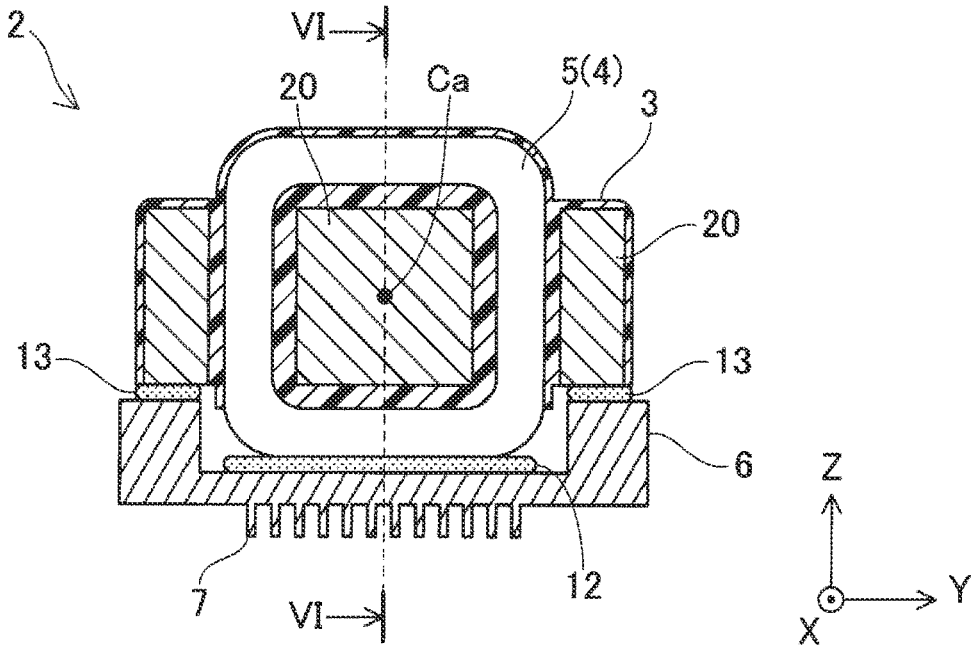
FIG. 3 is a sectional view taken along a line III-III of FIG. 1.

A reactor 2 according to the embodiment will be described with reference to the drawings. FIG. 1 is a perspective view showing the reactor 2. The reactor 2 is a passive element having a core 20 around which a coil 5 is wound. In FIG. 1, the core 20 and the coil 5 are covered with a resin cover 3, and are invisible. The reactor 2 is used for, for example, a chopper-type step-up converter that is mounted in, for example, an electric vehicle. A running motor of the electric vehicle can output several tens of kilowatts, and an electric power of several tens of kilowatts flows through the coil 5 of the reactor 2. The coil 5, through which a large electric power flows, generates a large amount of heat. Therefore, the reactor 2 is equipped with a cooler 6. FIG. 2 is a perspective view showing the reactor 2 from which the resin cover 3 and the core 20 have been removed. Besides, FIG. 3 is a sectional view taken along a line III-III of FIG. 1. In FIG. 2, the core 20 is depicted by a virtual line.

The structure of the reactor 2 will be described with reference to FIGS. 2 and 3. The coil 5 is formed by winding a wire 4 into the shape of a prism. The coil 5 is obtained by winding the wire 4, which are rectangular, in an edgewise manner. The term "edgewise" refers to a winding method in which a rectangular wide surface is oriented in an axial direction of the coil. The axial direction of the coil is an extending direction of an axis of the coil, and is an X-direction in a coordinate system in the drawing.

The coil 5 assumes the shape of a quadrangular prism, and has four flat lateral surfaces. Each of "the flat lateral surfaces of the coil 5" means a flat surface parallel to an axis Ca of the coil 5. For the sake of convenience of explanation, the flat lateral surface oriented in a +Z-direction in the coordinate system in the drawing will be referred to as an upper surface 5*a*, and the flat lateral surface oriented in a −Z-direction will be referred to as a lower surface 5*d*. Besides, the flat lateral surface oriented in a +Y-direction will be referred to as a right lateral surface 5*b*, and the flat lateral surface oriented in a −Y-direction will be referred to as a left lateral surface 5*c*.

The cooler 6 is opposed to the lower surface 5*d* of the coil 5 across the insulating heat radiation layer 12. In other words, the lower surface 5*d* of the coil 5 is thermally in contact with the cooler 6 across the insulating heat radiation layer 12. Besides, a lower surface of the core 20 is thermally in contact with the cooler 6 via an insulating heat radiation layer 13. A plurality of fins 7 are provided on a lower surface of the cooler 6. Although not shown in the drawing, the lower surface of the cooler 6 faces a coolant flow passage, and the fins 7 are exposed to liquid coolant.

The insulating heat radiation layers 12 and 13 are made of silicon rubber exhibiting resistance to high temperatures and flexibility. Both the coil 5 and the cooler 6 are made of metal. Therefore, even when the coil 5 and the cooler 6 are in direct contact with each other, there is created a gap therebetween. Thus, the soft insulating heat radiation layer 12 is sandwiched between the coil 5 and the cooler 6, so as to provide assistance in transmitting heat from the coil 5 to the cooler 6. The insulating heat radiation layer 13 also has a similar purpose. It should be noted, however, that since the coil 5 generates heat, the efficiency of heat transmission from the lower surface 5*d* of the coil 5 to the cooler 6 particularly influences the cooling performance of the coil 5. Therefore, the efficiency of heat transmission from the coil 5 to the insulating heat radiation layer 12 is desired to be high. One method of enhancing the efficiency of heat transmission from the coil 5 to the insulating heat radiation layer 12 is to reduce the degree of flatness of the lower surface 5*d* of the coil 5. In the case where the degree of flatness of the lower surface 5*d* is high, when the lower surface 5*d* is pressed against the insulating heat radiation layer 12, the variation in the gap between the lower surface 5*d* and the cooler 6 becomes large. When the variation in the gap is large, there are spots where the insulating heat radiation layer 12 has a large thickness. The thermal resistance of the insulating heat radiation layer 12 increases as the thickness thereof increases. Therefore, the efficiency of heat transmission deteriorates at the spots where the insulating heat radiation layer 12 is thick. In the case where the degree of flatness of the lower surface 5*d* is low, when the lower surface 5*d* is pressed against the insulating heat radiation layer 12, the variation in the gap between the lower surface 5*d* and the cooler 6 becomes small. When the variation in the gap is small, the thickness of the insulating heat radiation layer 12 is uniform, heat is uniformly transmitted from the entire lower surface 5*d* to the insulating heat radiation layer 12, and the efficiency of heat transmission is enhanced. Besides, the variation in the coil surface as the first lateral surface has become small, so the insulating heat radiation layer 12 can be reduced in thickness.

Figure 4:
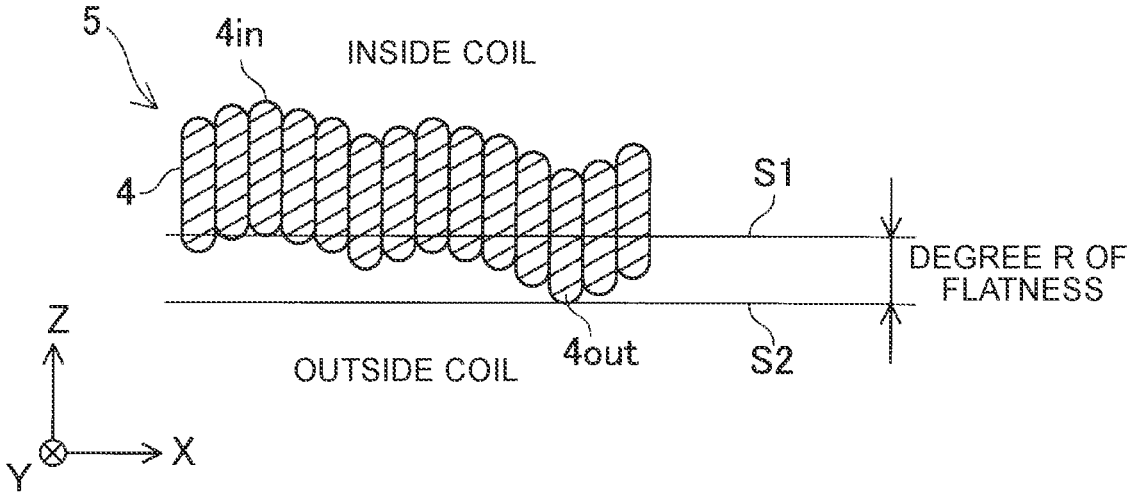
FIG. 4 is a sectional view of a coil for illustrating a degree of flatness.

As described previously, the degree of flatness may be evaluated as a maximum inclination-type degree of flatness. The degree of flatness of the lateral surface of the coil will be concretely described using FIG. 4. FIG. 4 is a view schematically showing part of a section of the coil 5. An upper side in the drawing corresponds to an inner side of the coil, whereas a lower side in the drawing corresponds to an outer side of the coil. The coil 5 is obtained by winding the rectangular wire 4 in an edgewise manner. The wire 4 is made of copper, which exhibits small internal resistance and high thermal conductivity. In the case of edgewise winding, the rectangular wire 4 is forcefully bent, so the position of the winding of each pitch is unlikely to remain the same due to the occurrence of springback or the like. As shown in FIG. 4, the position of each of the portions of the wire (i.e., the position of each winding) in a radial direction thereof may differ depending on the pitch. In FIG. 4, a plane S1 (an ideal plane S1) is a plane that is in contact with a winding 4 in, which is located on an innermost side of the coil, in an outer portion of the coil. A plane S2 (an ideal plane S2) is a plane that is in contact with a winding 4 out, which is located on an outermost side of the coil, in an outer portion of the coil. The plane S1 and the plane S2 are parallel to each other. Ridge lines of all the portions of the wire (i.e., all the windings) constituting one lateral surface of the coil 5 in an outer portion of the coil 5 are contained between the ideal planes S1 and S2. Thus, according to the definition of the maximum inclination-type degree of flatness, a distance R between the ideal planes S1 and S2 represents the degree of flatness of the lateral surface of the coil. That is, "that the degree of flatness of the lateral surface of the coil is low" means that there is a short distance between the plane that is in contact with the winding located on the innermost side of the coil in an outer portion of the coil and the plane that is in contact with the winding located on the outermost side of the coil in an outer portion of the coil.

Figure 5:
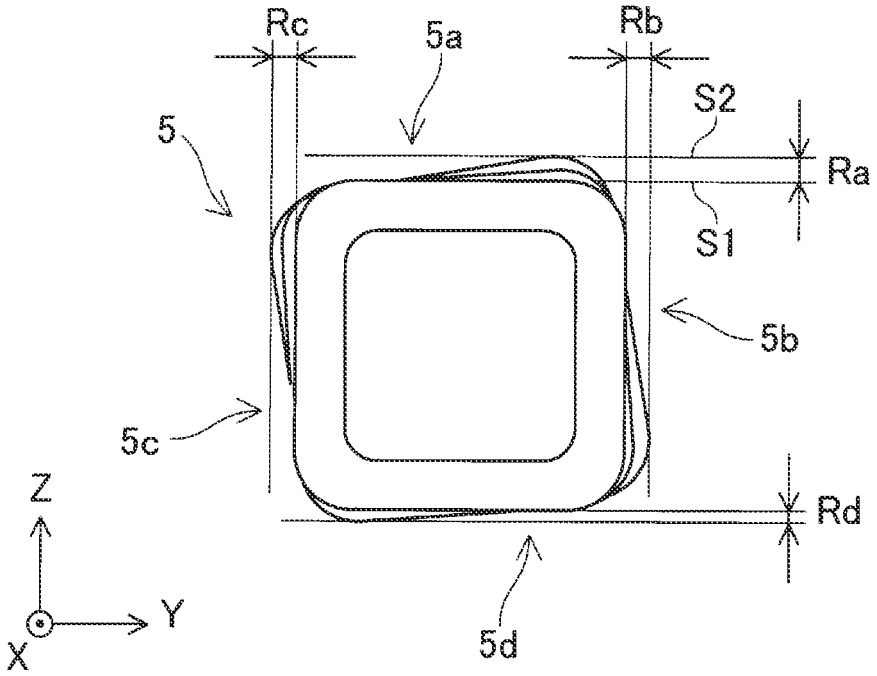
FIG. 5 is a front view of the coil.

FIG. 5 is a front view showing the coil 5. FIG. 5 schematically shows the degree of flatness of each of the lateral surfaces of the coil 5. A degree Ra of flatness of the upper surface 5*a* is represented by a distance between the ideal plane S1 that is in contact with a most recessed spot of the upper surface 5*a* and the ideal plane S2 that is parallel to the ideal plane S1 and that is in contact with a most protrusive spot of the upper surface 5*a*. The position of the winding in the radial direction of the coil of each pitch varies, so the degree Ra of flatness is relatively high. Immediately after the coil 5 has been created, a degree Rb of flatness of the right lateral surface 5*b*, a degree Rc of flatness of the left lateral surface 5*c*, and a degree Rd of flatness of the lower surface 5*d* are also approximately equal to the degree Ra of flatness. The rectangular wire 4 exhibits high rigidity, so there is a limit to making the degrees of flatness of all the lateral surfaces low. When the degrees of flatness of all the lateral surfaces are made low, a large stress is applied to various spots of the coil 5. This is because the stress emerges in the form of springback, and the degrees of flatness that have once been made low are increased again.

Thus, in the coil 5 of the reactor 2 according to the embodiment, the degree Rd of flatness of the lower surface 5*d* that is opposed to the insulating heat radiation layer 12 is made low, and instead, the degrees of flatness of the other flat lateral surfaces (the upper surface 5*a*, the right lateral surface 5*b*, and the left lateral surface 5*c*) are allowed to be relatively high. In other words, the degree Rd of flatness of the lower surface 5*d* that is in contact with the insulating heat radiation layer 12 is made lower than the degrees Ra, Rb, and Rc of flatness of the other lateral surfaces. As a result, the stress applied to the coil 5 becomes small, and the amount of springback also becomes small. Accordingly, the low degree of flatness of the lower surface 5*d* can be maintained, and the efficiency of heat transmission from the lower surface 5*d* to the insulating heat radiation layer 12 is enhanced.

Figure 6:
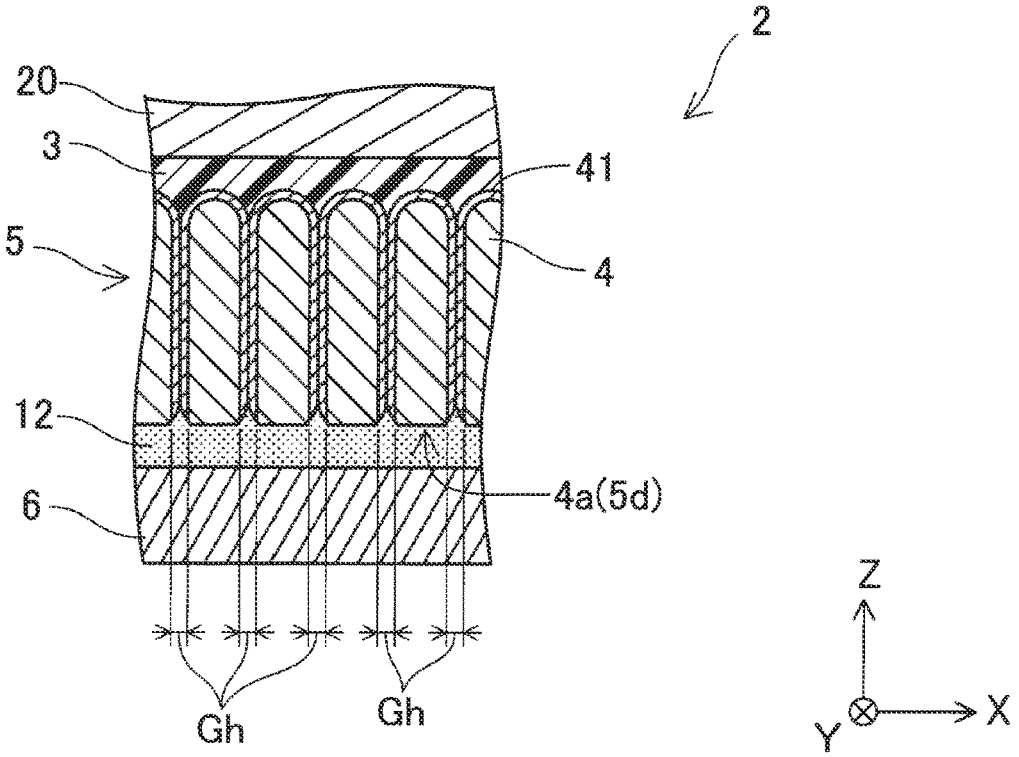
FIG. 6 is a sectional view taken along a line VI-VI of FIG. 3.

FIG. 6 is view showing part of a section taken along a line VI-VI of FIG. 3. The section of FIG. 6 corresponds to a section obtained by cutting the coil 5 along a plane containing the axis Ca (see FIG. 3) of the coil 5. The axis Ca extends parallel to the X-axis of the coordinate system in the drawing. FIG. 6 is a partial sectional view of a region constituting the lower surface 5*d* of the coil 5. Besides, FIG. 6 shows only part of the direction of the axis Ca of the coil 5. Each of the portions of the wire 4 of the coil 5 is covered with an insulating film 41 to prevent short-circuiting to the portion of the wire 4 of an adjacent pitch. In FIG. 6, a reference numeral 4 (the wire 4) and a reference numeral 41 (the insulating film 41) are assigned only to the rightmost winding, and no reference numeral is assigned to the other windings (the other portions) of the wire. The insulating film 41 is typically an enameled film.

The wire 4 is made of a metal exhibiting high thermal conductivity, such as copper or the like. The thermal conductivity of the insulating film 41 is not as high as that of a metal such as copper or the like. In the reactor 2 according to the embodiment, the insulating film has been removed from those regions of the portions of the wire 4 which are in contact with the insulating heat radiation layer 12, with a view to enhancing the efficiency of heat transmission from the coil 5 to the insulating heat radiation layer 12. As described previously, the surfaces from which the insulating film has been removed will be referred to as exposed surfaces 4*a*. An aggregate of the exposed surfaces 4*a* of the portions of the wire 4 constitutes the lower surface 5*d* of the coil 5. In other words, each of the exposed surfaces 4*a* of the portions of the wire 4 is a surface corresponding to the lower surface 5*d* of the coil 5. In FIG. 6, a reference symbol 4*a* is assigned only to one of the outer lateral surfaces. As will be described later, the insulating film is removed through polishing. The portions of the wire 4 are also partially flattened through polishing. Therefore, the exposed surfaces 4*a* are flat. The insulating film 41, which forms a surface corresponding to the lower surface 5*d* of the portions of the wire 4, has been removed, and the copper portions of the wire 4 are thus in direct contact with the insulating heat radiation layer 12. Therefore, the efficiency of heat transmission from the portions of the wire 4 (the coil 5) to the insulating heat radiation layer 12 is enhanced.

In the reactor 2 according to the embodiment, the following two features contribute towards enhancing the efficiency of heat transmission from the coil 5 to the insulating heat radiation layer 12. (1) The degree Rd of flatness of the lower surface 5*d* that is in contact with the insulating heat radiation layer 12 of the coil 5 is low. (2) The insulating film 41 has been removed from the portions of the wire 4 on the lower surface 5*d*.

Incidentally, as shown in FIG. 6, one of the exposed surfaces 4*a* and the exposed surface 4*a* of a pitch adjacent thereto are spaced apart from each other by a gap Gh, and do not short-circuit to each other. In general, the gap Gh is slightly larger than the double of the thickness of the insulating film 41.

First Modification Example

Figure 7:
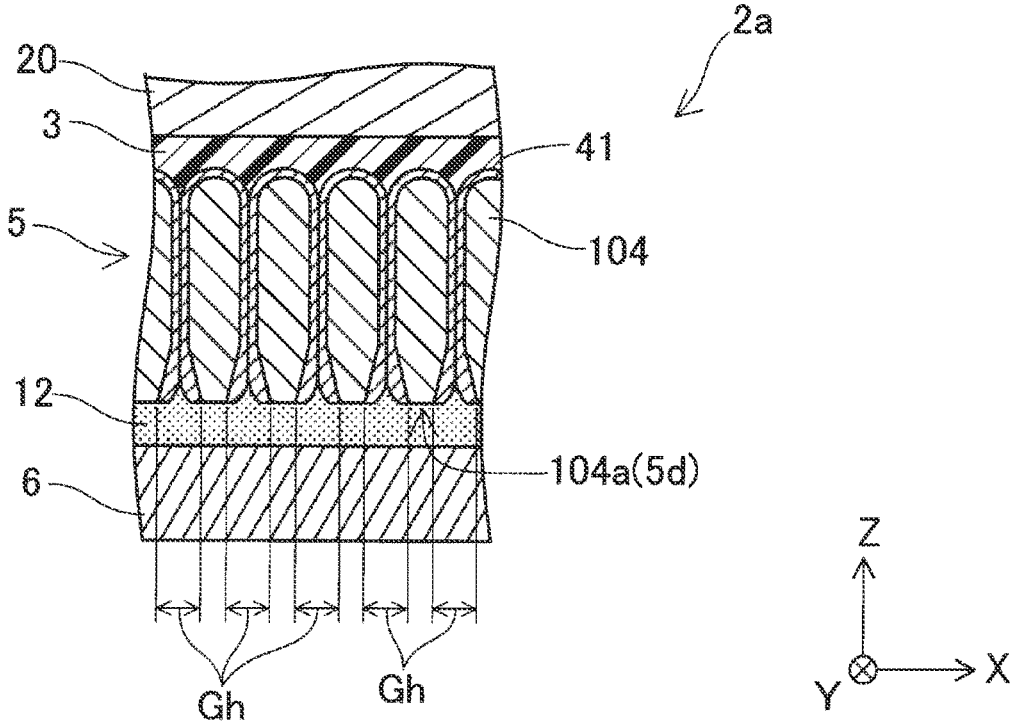
FIG. 7 is a sectional view of a coil of a reactor according to a first modification example.

FIG. 7 is a sectional view showing a section of a coil of a reactor 2*a* according to a first modification example. The section of FIG. 7 corresponds to the section of FIG. 6. That is, FIG. 7 shows a shape of the section of portions of the wire 104 obtained by cutting those regions of the portions of the wire 104 which are in contact with the insulating heat radiation layer 12 along a plane containing an axis of the coil. The wire 104 is a rectangular wire, and is wound in an edgewise manner.

The insulating film 41 has been removed from the portions of the wire 104 constituting the coil 5, on the lower surface 5*d* of the coil 5 that is in contact with the insulating heat radiation layer 12. Surfaces from which the insulating film 41 has been removed will be referred to as exposed surfaces 104*a*. Besides, a sectional shape of each of the portions of the wire 104 obtained by cutting those regions of the portions of the wire 104 which are in contact with the insulating heat radiation layer 12 along a plane containing an axis of the coil 5 is tapered toward the outer side of the coil. In other words, in the sectional shape obtained by cutting that region of the coil 5 which is in contact with the insulating heat radiation layer 12 along the plane containing the axis of the coil, a gap is provided between portions of the wire 104 that are adjacent to each other in an outer portion of the coil 5. The section of each of the portions of the wire 104 is tapered toward the outer side of the coil, so the distance (the gap Gh) between the exposed surfaces 104*a* that are adjacent to each other in the pitch direction is longer than in the case of the embodiment. Since the gap Gh becomes long, the exposed surfaces 104*a* that are adjacent to each other can be more reliably prevented from short-circuiting to each other.

The insulating heat radiation layer 12 insulates the exposed metal of the portions of the wire 4 from the cooler 6. As shown in FIG. 4, when the degree of flatness of each of the lateral surfaces of the coil 5 is high, there is a large difference between the winding 4out located closest to the cooler 6 and the winding 4in located furthest from the cooler 6. When there is a large difference between the winding 4out located closest to the cooler 6 and the winding 4in located furthest from the cooler 6, the thickness of the insulating heat radiation layer 12 needs to be increased to ensure contact with all the portions of the wire. When the insulating heat radiation layer 12 has a large thickness, a fissure is likely to be created in the inside of the insulating heat radiation layer 12, in addition to a fall in the efficiency of heat transmission. When a fissure is created, air enters the fissure to cause a further fall in the efficiency of heat transmission. The insulating heat radiation layer 12 is held in a pressurized state between the coil 5 and the cooler 6.

Therefore, after long-term use, a fissure may be created in the insulating heat radiation layer 12 due to time degradation. The temperature of the coil 5 repeatedly rises due to heat generation and falls due to cooling. This thermal cycle also accelerates time degradation of the insulating heat radiation layer 12. The possibility of a fissure being created increases as the thickness of the insulating heat radiation layer 12 increases. In the reactor 2 according to the embodiment, the insulating heat radiation layer 12 can be made thin, so the possibility of a fissure being created can be made low.

Second Modification Example

Figure 8:
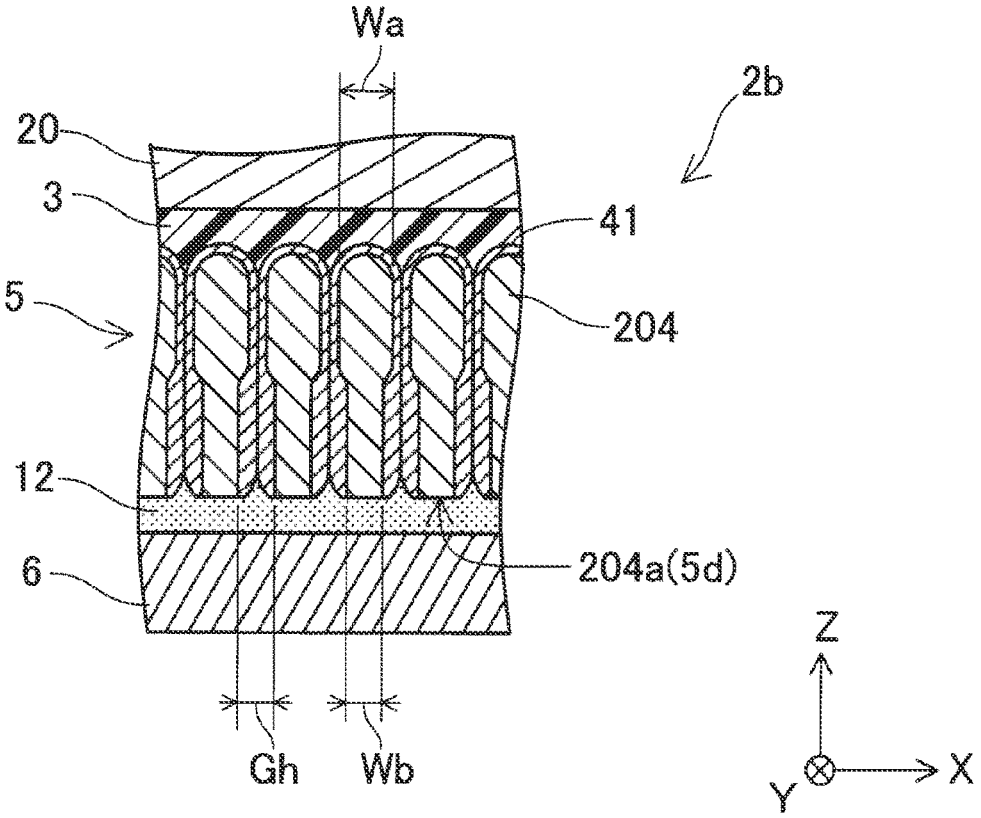
FIG. 8 is a sectional view of a coil of a reactor according to a second modification example.

FIG. 8 is a sectional view showing a section of a coil of a reactor 2*b* according to a second modification example. The section of FIG. 8 corresponds to the section of FIG. 6. That is, FIG. 8 shows a shape of a section of each of portions of the wire 204 obtained by cutting that region of each of the portions of the wire 204 which is in contact with the insulating heat radiation layer 12 along a plane containing an axis of the coil. The wire 204 is a rectangular wire, and is wound in an edgewise manner.

A thickness Wa of the wire 204 in an inner portion of the coil is larger than a thickness Wb of the wire 204 in an outer portion of the coil. It should be noted herein that the thickness of the wire 204 means a width of a conductor region of the wire 204 in an axial direction of the coil (the X-direction in the drawing). In the case of the second modification example, that region of the insulating film 41 which is in contact with the insulating heat radiation layer 12 and which is located in an outer portion of the coil has a large thickness, and that region of the insulating film 41 which is not in contact with the insulating heat radiation layer 12 and which is located in an inner portion of the coil has a small thickness. By changing the width of the wire 204 and the thickness of the insulating film 41 in accordance with their positions in the radial direction of the coil, the large gap Gh can be ensured between one of exposed surfaces 204*a* of the wire 204 and another exposed surface 204*a* that is adjacent thereto in the pitch direction. The large gap Gh more reliably prevents the exposed surfaces 204*a* that are adjacent to each other from short-circuiting to each other.

Third Modification Example

Figure 9:
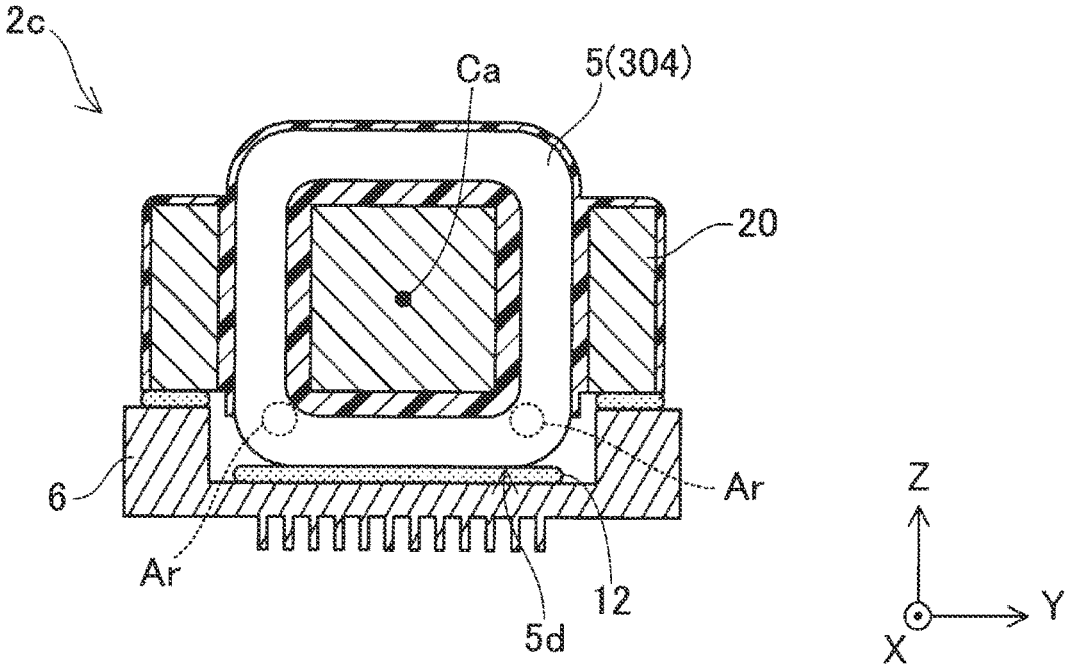
FIG. 9 is a sectional view of a reactor according to a third modification example.

FIG. 9 is a sectional view showing a section of a reactor 2*c* according to a third modification example. The sectional view of FIG. 9 corresponds to the sectional view of FIG. 3. The wire 304 of the reactor 2*c* according to the third modification example is a rectangular wire, and is wound in an edgewise manner. In the portions of the wire 304, a coil corner portion that is adjacent to the lower surface 5*d* is thicker on an inner peripheral side of the coil than on an outer peripheral side of the coil, as viewed in a direction of the axis Ca of the coil 5. Each of ranges indicated by broken lines Ar in FIG. 9 (areas Ar) indicates an area of the coil corner portion adjacent to the lower surface 5*d* on the inner peripheral side of the coil. The large thickness of each of the areas Ar can also make it possible to increase the gap between the adjacent exposed surfaces of the portions of the wire 304 corresponding to the lower surface 5*d* of the coil. By increasing the gap between the exposed surfaces that are adjacent to each other in the pitch direction, the exposed surfaces can be more reliably prevented from short-circuiting to each other.

The coil 5 is obtained by winding the rectangular wire 304 in an edgewise manner into the shape of a quadrangular prism. In the case where the rectangular wire 304 is wound into the shape of a quadrangular prism, a jig is placed on inner sides of corner portions of the quadrangular prism to bend the wire 304. The wire 304 is bent while being pressed hard against the jig. Thus, the regions of the areas Ar can be plastically deformed, and the thickness of conductor regions of the wire 304 can be increased.

Fourth Modification Example

Figure 10:
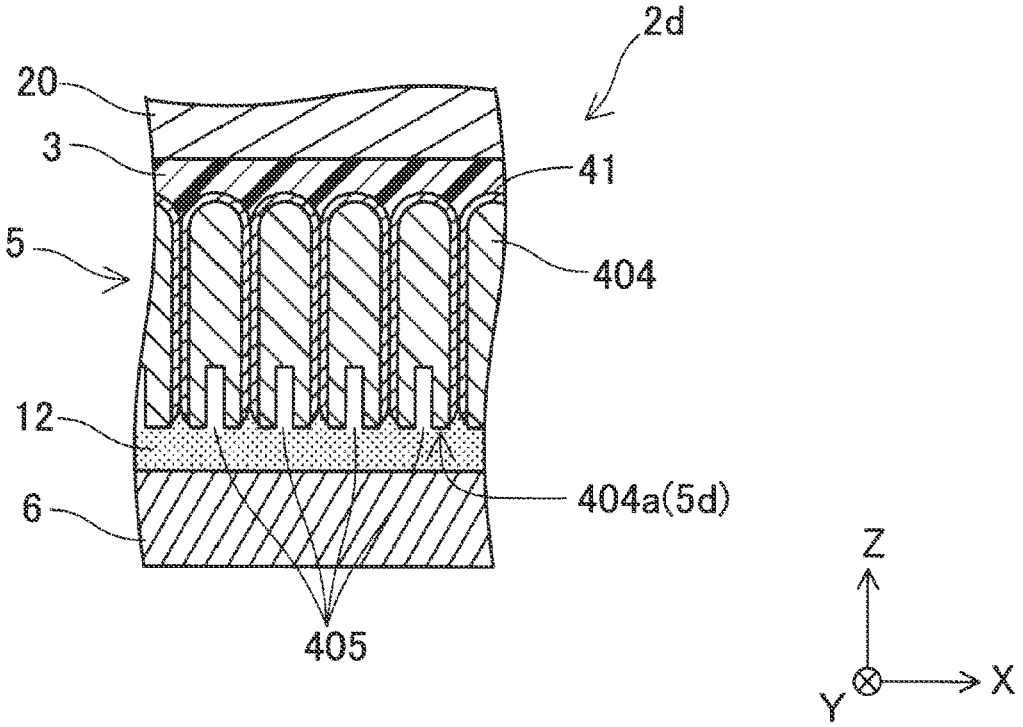
FIG. 10 is a sectional view of a coil of a reactor according to a fourth modification example.

FIG. 10 is a sectional view showing a section of a coil of a reactor 2*d* according to a fourth modification example. The section of FIG. 10 corresponds to the section of FIG. 6. That is, FIG. 10 shows a sectional shape of portions of the wire 404 obtained by cutting those regions of the portions of the wire 404 which are in contact with the insulating heat radiation layer 12 along a plane containing an axis of the coil.

The portions of the wire 404 have exposed surfaces 404*a* that have slits 405 respectively. The slits 405 are provided toward the inner side of the coil from the exposed surfaces 404*a* of the coil 5 respectively. The slits 405 extend in an extending direction of the respective portions of the wire 404 of the coil 5. Each of the slits 405 prevents each of the portions of the wire 404 from approaching the portions of the wire 404 that are adjacent thereto, due to thermal expansion. Conductors are exposed from the exposed surfaces 404*a* respectively. The slits 405 contribute towards preventing the exposed surfaces 404*a* that are adjacent to each other from short-circuiting to each other. Incidentally, there is no limit to the shape of the slits 405. For example, a plurality of short slits that are inclined with respect to the extending direction of the wire may be provided.

Figure 11:
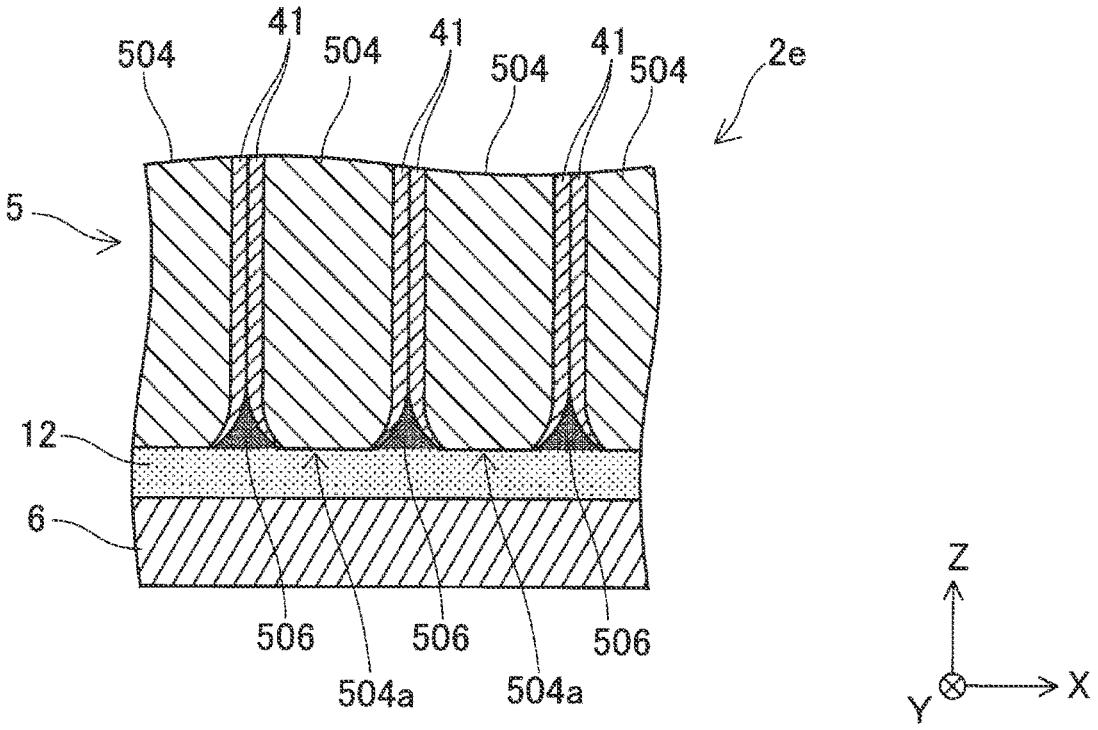
FIG. 11 is a sectional view of a coil of a reactor according to a fifth modification example.

Fifth Modification Example (Fifth Modification Example) FIG. 11 is a sectional view showing a section of a coil of a reactor 2*e* according to a fifth modification example. The section of FIG. 11 corresponds to a section obtained by further enlarging the section of FIG. 6. That is, FIG. 11 shows a sectional shape of portions of the wire 504 obtained by cutting those regions of the portions of the wire 504 which are in contact with the insulating heat radiation layer 12 along a plane containing an axis of the coil. In the reactor 2*e* according to the fifth modification example, spaces between the portions of the wire that are adjacent to each other in the pitch direction (the X-direction in the drawing) are filled with an insulating material 506, in those regions of the portions of the wire 504 which are in contact with the insulating heat radiation layer 12. When conductive dust or the like is stuck near exposed surfaces 504*a* of the portions of the wire 504, the exposed surfaces 504*a* that are adjacent to each other in the pitch direction may short-circuit to each other. By filling the spaces between the portions of the wire 504 that are adjacent to each other with the insulating material 506, conductive dust can be prevented from being stuck therebetween.

Sixth Modification Example

Figure 12:
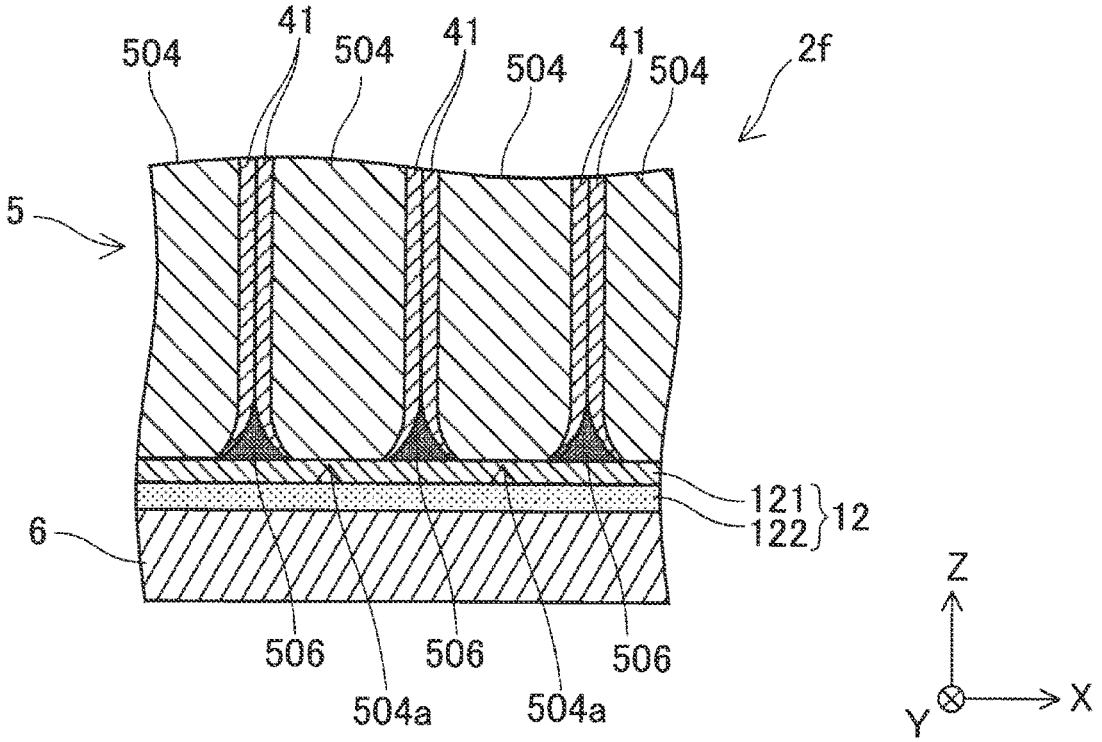
FIG. 12 is a sectional view of a coil of a reactor according to a sixth modification example.

FIG. 12 is a sectional view showing a section of a coil of a reactor 2*f* according to a sixth modification example. The sectional view of FIG. 12 corresponds to the sectional view of FIG. 11. In the reactor 2*f* according to the sixth modification example, the insulating heat radiation layer 12 includes two layers (an insulating ceramic board 121 and a silicon sheet 122). The insulating ceramic board 121 is arranged on the side of the exposed surfaces 504*a* of the portions of the wire 504, and the silicon sheet 122 is arranged on the side of the cooler 6. The insulating ceramic board 121 is in contact with the coil 5 (the exposed surfaces 504*a* of the portions of the wire 504).

The cooler 6 is made of conductive aluminum. When there are small air bubbles (microvoids) between the conductive cooler 6 and the coil 5, corona discharge may occur. Corona discharge causes carbonization of resin and the insulating film. The carbonized resin and the carbonized insulating film exhibit conductivity, so the exposed surfaces 504*a* that are adjacent to each other in the pitch direction may short-circuit to each other. The insulating heat radiation layer 12 includes the insulating ceramic board 121 that is in contact with the coil 5, so carbonization does not occur near the exposed surfaces 504*a* that are adjacent to each other, which leads to the enhancement of reliability. Besides, a material with high thermal conductivity is selected for the insulating ceramic board 121. By adopting this insulating ceramic board 121, the effect of enhancing the efficiency of heat transmission from the coil 5 to the cooler 6 can also be expected.

In FIG. 12, the insulating ceramic board 121 is in direct contact with the exposed surfaces 504*a* of the portions of the wire 504. The insulating ceramic board 121 may be embedded in the silicon sheet 122. That is, the insulating ceramic board 121 is not required to be in contact with the exposed surfaces 504*a*.

Next, a method of manufacturing a reactor will be described with reference to FIGS. 13 to 15.

First of all, the rectangular wire 4 is wound into the shape of a prism having four flat lateral surfaces (the upper surface 5*a*, the lower surface 5*d*, the right lateral surface 5*b*, and the left lateral surface 5*c*) to create the coil 5. The rectangular wire 4 is wound in an edgewise manner. The wire 4 is covered with an insulating film along an entire circumference thereof. Part of the insulating film is removed later. That is, in a winding process, the wire 4 from which the insulating film has not been removed is wound into the coil 5 having at least one flat lateral surface.

Figure 13:
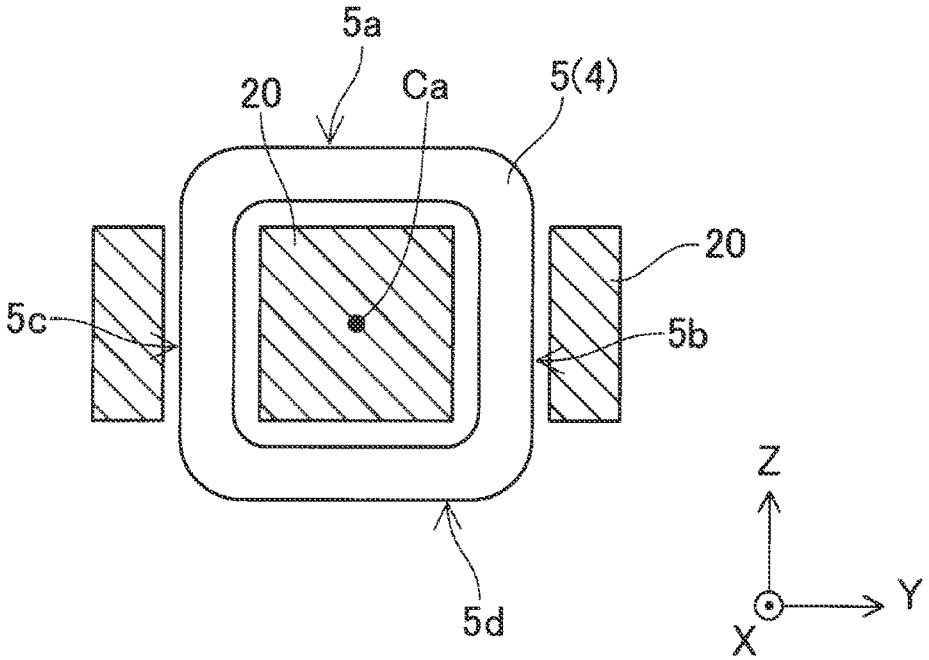
FIG. 13 is a view (1) illustrating a method of manufacturing the reactor according to the embodiment.

The completed coil 5 is inserted through the core 20 (FIG. 13). The core 20 is divided into a plurality of core blocks. After the coil 5 is inserted through the columnar core block at a center, the core blocks in the other regions are joined thereto, and the core 20 is thus completed.

Figure 14:
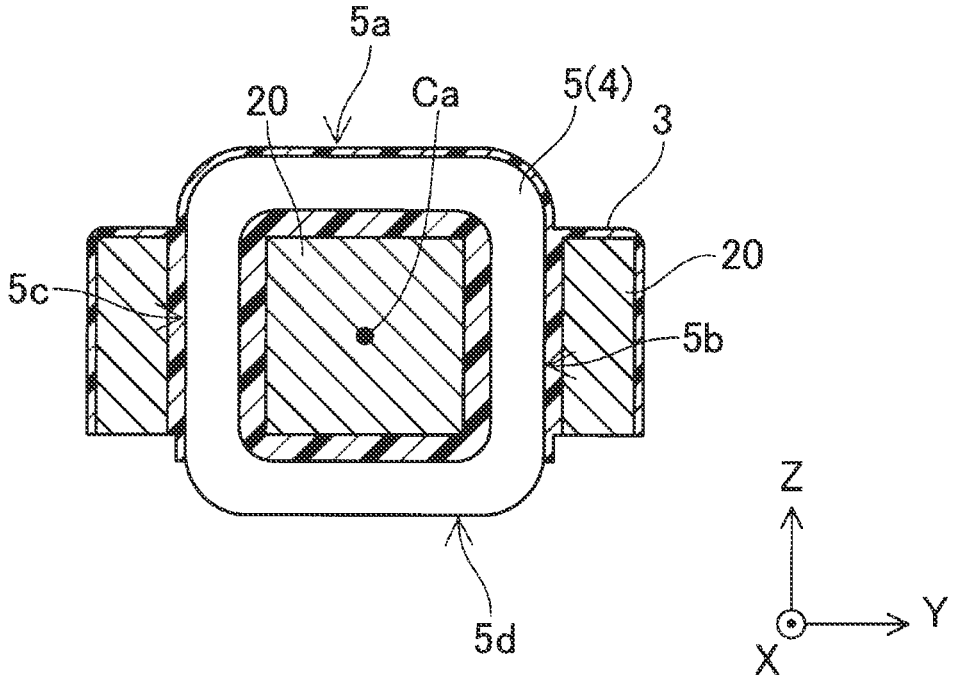
FIG. 14 is a view (2) illustrating a method of manufacturing the reactor according to the embodiment.
Figure 15:
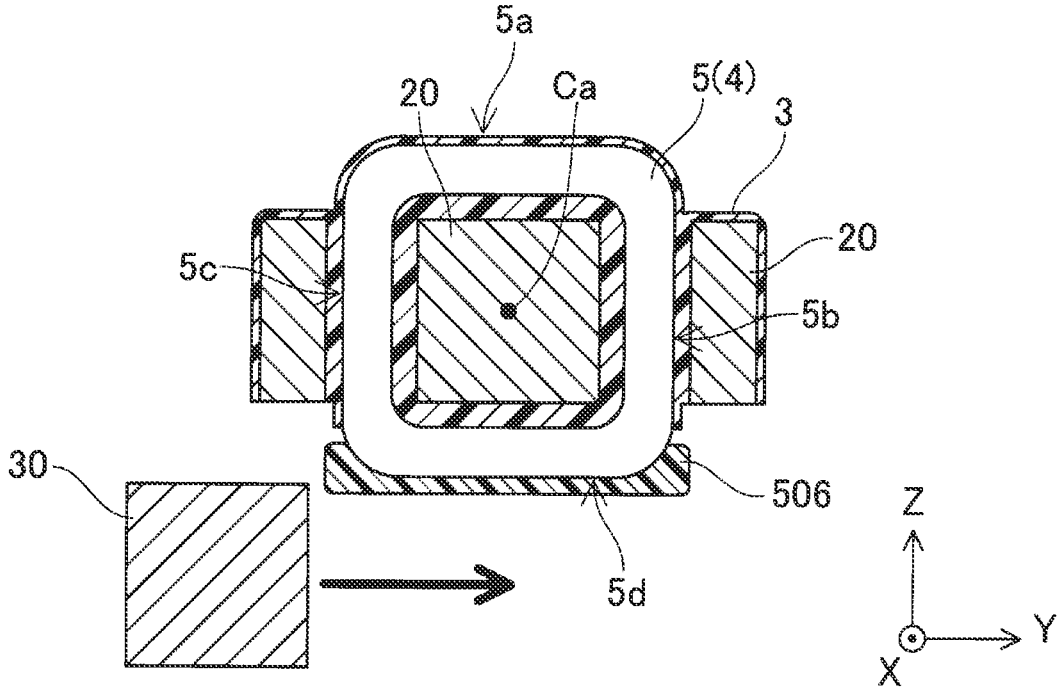
FIG. 15 is a view (3) illustrating a method of manufacturing the reactor according to the embodiment.

Subsequently, the resin cover 3 that covers the core 20 and the coil 5 is manufactured through mold forming (FIG. 14). At this time, the lower surface of the core 20 and the lower surface 5*d* of the coil 5 are exposed. The insulating heat radiation layers 12 and 13 are attached to exposed regions of the core 20 and the coil 5, and the cooler 6 is further attached thereto.

Subsequently, the hard insulating material 506 is applied onto the exposed lower surface 5*d* of the coil 5. After the insulating material 506 has hardened, the lower surface 5*d* is polished (FIG. 15). Each space between the portions of the wire 4 that are adjacent to each other in the pitch direction is filled with the insulating material 506, on the lower surface 5*d* of the coil 5. The insulating material 506 is harder than the insulating film covering the wire 4. Incidentally, the process of applying the insulating material 506 is a process required for the foregoing fifth modification example, and is not an absolutely indispensable process. Then, the lower surface 5*d* is polished to remove the insulating film, so that the degree of flatness of the lower surface 5*d* becomes lower than the degrees of flatness of the other lateral surfaces (the upper surface 5*a*, the right lateral surface 5*b*, and the left lateral surface 5*c*). At this time, the lateral surfaces other than the lower surface 5*d* (the upper surface 5*a*, the right lateral surface 5*b*, and the left lateral surface 5*c*) are not restrained, and the degrees of flatness thereof are allowed to be high. Thus, the stress applied to the various spots of the coil 5 is alleviated.

The insulating material 506 fills up the spaces among the portions of the wire such that no polishing waste remains among the portions of the wire. Besides, as shown in FIG. 15, the insulating material 506 also covers the corner portion that is adjacent to the lower surface 5*d* of the coil 5. The insulating film 41 that covers the wire 4 is soft, and may adhere to a polishing surface of a grinder 30 when the grinder 30 separates from the coil 5. A thick arrow in FIG. 15 indicates a moving direction of the grinder 30. In FIG. 15, the grinder 30 that has polished the lower surface 5*d* separates from the lower-right corner portion of the coil 5. By covering the corner portion that is adjacent to the lower surface 5*d* of the coil 5 (especially, the corner portion from which the grinder 30 separates) with the hard insulating material 506, the insulating film 41 can be prevented from adhering to the polishing surface of the grinder 30.

Finally, the insulating heat radiation layer 12 is stuck onto the lower surface 5*d* of the coil 5 from which the insulating film has been removed, the insulating heat radiation layer 13 is stuck onto the lower surface of the core 20, and the cooler 6 is attached to the opposite side of the insulating heat radiation layer. Incidentally, the insulating heat radiation layers 12 and 13 are liquid in their initial states, and are applied to the lower surface 5*d* of the coil 5 and the lower surface of the core 20 respectively. The cooler is attached before the liquid insulating heat radiation layers 12 and 13 are hardened. When the liquid insulating heat radiation layers 12 and 13 are hardened, the lower surface 5*d* of the coil 5 (and the lower surface of the core 20) and the cooler 6 come into close contact with each other via the insulating heat radiation layers 12 and 13 respectively. That is, the insulating heat radiation layer 12 (13) serves as an adhesive for bringing the coil 5 (the core 20) into close contact with the cooler 6.

Points to keep in mind about the art described in the embodiment will be described. In the embodiment and the modification examples thereof, the lower surface 5*d* of the coil, which assumes the shape of a quadrangular prism, is opposed to the cooler 6, and the other lateral surfaces (the upper surface 5*a*, the right lateral surface 5*b*, and the left lateral surface 5*c*) are not opposed to the cooler 6. The lower surface 5*d* that is opposed to the cooler 6 is an example of the first lateral surface, and each of the other lateral surfaces (the upper surface 5*a*, the right lateral surface 5*b*, and the left lateral surface 5*c*) is an example of the second lateral surface.

The coil may have two or more flat lateral surfaces that are opposed to the cooler via the insulating heat radiation layer. The insulating heat radiation layer is stuck onto each of the flat lateral surfaces. Each of the plurality of the flat lateral surfaces that are opposed to the cooler is an example of the first lateral surface, and the lateral surface that is not opposed to the cooler is an example of the second lateral surface. Even in this case, the degree of flatness of each of the plurality of the first lateral surfaces is lower than the degree of flatness of the second lateral surface that is not opposed to the cooler.

The coil according to the embodiment has four flat lateral surfaces. The reactor may have two or more flat lateral surfaces, or may have only one flat lateral surface. For example, the coil of the reactor may have a flat lateral surface, and a curved surface that is connected to both ends of the flat lateral surface.

A metal filler may be mixed into the insulating heat radiation layer 12 to enhance the efficiency of heat transmission. The metal filler makes it easy to produce cracks (air bubbles). The art according to the embodiment that can make the insulating heat radiation layer 12 thin is especially effective for the reactor that is equipped with the insulating heat radiation layer 12 into which the metal filler has been mixed.

In a process of assembling the reactor, the insulating heat radiation layer 12 is stuck onto the cooler 6 while being deployed from its rolled state, so as not to induce air between the insulating heat radiation layer 12 and the cooler 6. When the insulating heat radiation layer 12 is thick, the bending rigidity thereof is high. As a result, when the insulating heat radiation layer 12 is rolled, a fissure is likely to be created therein. The art described in the embodiment can make the thickness of the insulating heat radiation layer small. Consequently, even when the insulating heat radiation layer is rolled, a fissure is unlikely to be created therein.

In the manufacturing method described in the embodiment, the insulating film is removed through polishing, and at the same time, the degrees of flatness of the lateral surfaces of the coil are enhanced. The insulating film can also be removed by applying laser light or a solvent thereto. However, the application of laser light or the solvent does not always lead to the enhancement of the degrees of flatness of the lateral surfaces of the coil.

Although the concrete examples of the disclosure have been described above in detail, these are nothing more than exemplifications and do not limit the claims. The art set forth in the claims encompasses various modifications and alterations of the concrete examples exemplified above. The technical elements described in the present specification or the drawings are technically useful alone or in various combinations, and are not limited to the combinations mentioned in the claims at the time of the filing of the application. Besides, the art exemplified in the present specification or the drawings can achieve a plurality of objects at the same time, and is technically useful by achieving one of the objects alone.

What is claimed is:

1. A reactor comprising:

a coil including a wire that is covered with an insulating film and is wound, the coil having an inner side and an outer side and including on the outer side a first lateral surface and a second lateral surface different from the first lateral surface;

a cooler that faces the first lateral surface; and an insulating heat radiation layer that is sandwiched between the first lateral surface and the cooler, wherein in the first lateral surface, the wire is not covered with the insulating film in the second lateral surface, the wire is covered with the insulating film, and a degree of flatness of the first lateral surface is lower than a degree of flatness of the second lateral surface, wherein the degree of flatness of the respective lateral surface of the coil is represented by a distance between a respective plane S1, that is on the respective lateral surface in contact with a winding turn of the coil defining an innermost portion of the respective lateral surface and a respective plane S2 that is on the respective lateral surface in contact with a winding turn of the coil defining an outermost portion of the respective lateral surface, the plane S1 and the plane S2 being parallel to each other, wherein the degree of flatness being lower meaning that there is a shorter distance between plane S1 and plane S2 for the first lateral surface, as compared to a distance between plane S1 and plane 2 of the second lateral surface.

2. The reactor according to claim 1, wherein:

the coil includes the wire that is a rectangular wire wound in an edgewise manner; and in an outer region of a sectional shape of the coil obtained by cutting a region of the coil which is in contact with the insulating heat radiation layer along a plane containing an axis of the coil, a gap is provided between portions of the wire that are adjacent to each other.

3. The reactor according to claim 1, wherein:

the coil includes the wire that is a rectangular wire wound in an edgewise manner; and in a region of the coil which is in contact with the insulating heat radiation layer, a thickness of the wire in an inner portion of the coil is larger than a thickness of the wire in an outer portion of the coil.

4. The reactor according to claim 1, wherein:

the coil includes the wire that is a rectangular wire wound in an edgewise manner; and a thickness of the wire at a corner portion of the coil that is adjacent to the first lateral surface is larger on an inner peripheral side of the coil than on an outer peripheral side of the coil as viewed in an axial direction of the coil.

* * * * *